US011786026B2

(12) United States Patent
Frandsen

(10) Patent No.: US 11,786,026 B2
(45) Date of Patent: Oct. 17, 2023

(54) MULTI COMPARTMENT FAMILY TRAVEL BAG

(71) Applicant: Melinda Isaac Frandsen, Grand Junction, CO (US)

(72) Inventor: Melinda Isaac Frandsen, Grand Junction, CO (US)

( * ) Notice: Subject to any disclaimer, the term of this patent is extended or adjusted under 35 U.S.C. 154(b) by 105 days.

(21) Appl. No.: 17/187,328

(22) Filed: Feb. 26, 2021

(65) Prior Publication Data

US 2021/0345745 A1 Nov. 11, 2021

Related U.S. Application Data

(60) Provisional application No. 62/982,077, filed on Feb. 27, 2020.

(51) Int. Cl.

| | |
|---|---|
| ***A45C 13/02*** | (2006.01) |
| ***A45C 3/00*** | (2006.01) |
| ***A45F 3/02*** | (2006.01) |
| ***A45F 3/04*** | (2006.01) |

(52) U.S. Cl.

CPC ..... *A45C 13/02* (2013.01); *A45C 3/00* (2013.01); *A45F 3/02* (2013.01); *A45F 3/04* (2013.01); *A45C 2003/007* (2013.01)

(58) Field of Classification Search

CPC ..... A45C 13/02; A45C 3/00; A45C 2003/007; A45F 3/02; A45F 3/04

See application file for complete search history.

(56) References Cited

U.S. PATENT DOCUMENTS

| | | | | | |
|---|---|---|---|---|---|
| D268,628 | S | * | 4/1983 | Stark | D3/286 |
| D281,649 | S | * | 12/1985 | Bomes | D3/287 |
| 4,966,279 | A | * | 10/1990 | Pearcy | A45C 3/00 441/32 |
| D358,160 | S | * | 5/1995 | Conway | D16/326 |
| D368,160 | S | * | 3/1996 | Carretta | D3/289 |
| 6,508,358 | B2 | * | 1/2003 | Cheng | A45C 13/02 190/111 |
| 7,624,777 | B2 | * | 12/2009 | Paller | A45C 3/00 383/117 |

(Continued)

FOREIGN PATENT DOCUMENTS

| | | | | |
|---|---|---|---|---|
| DE | 202016106650 U1 | * | 1/2017 | A45C 3/00 |
| FR | 2622088 A1 | * | 10/1987 | |
| JP | 2002065330 A | * | 3/2002 | |

*Primary Examiner* — Tri M Mai

(74) *Attorney, Agent, or Firm* — Lambert Shortell & Connaughton; David J. Connaughton, Jr.; Justin P. Tinger

(57) ABSTRACT

An improved soft-sided travel bag with a plurality of compartments opening along the top of the bag can be used to carry, access and organize multiple travelers within one contained bag. A departure from traditional duffle or travel bag design, there is no primary compartment built into the bag. Rather, multiple self-contained compartments unfasten or zip open along the top. This invention offers individuals traveling with children the ability to easily divide and organize items for every child within one bag. The plurality of compartments dividing the internal volume of the bag into multiple independent spaces are sewn forming dividers, end wall to end wall upon one another, as if adjoining multiple independent bags into one contained unit. Said compartments are designed with interior pockets to provide users with maximum organizational utility.

15 Claims, 4 Drawing Sheets

Angled Perspective View

(56) References Cited

U.S. PATENT DOCUMENTS

| | | | | |
|---|---|---|---|---|
| 8,869,960 | B2 * | 10/2014 | Mangano | A45C 5/14 280/654 |
| 9,420,859 | B2 * | 8/2016 | Bourette | A45C 7/0068 |
| 10,194,726 | B2 * | 2/2019 | Mosee | A45C 7/0086 |
| 10,736,391 | B2 * | 8/2020 | Seiders | A45F 3/04 |
| D921,360 | S * | 6/2021 | Wu | D3/233 |
| 2013/0188892 | A1 * | 7/2013 | Bevier | A45C 3/001 383/104 |
| 2015/0083537 | A1 * | 3/2015 | Ranly | A45C 3/00 190/111 |
| 2018/0352923 | A1 * | 12/2018 | Richards | A45C 9/00 |
| 2021/0145137 | A1 * | 5/2021 | Williams | F25D 3/08 |

* cited by examiner

FIGURE 1: Angled Perspective View
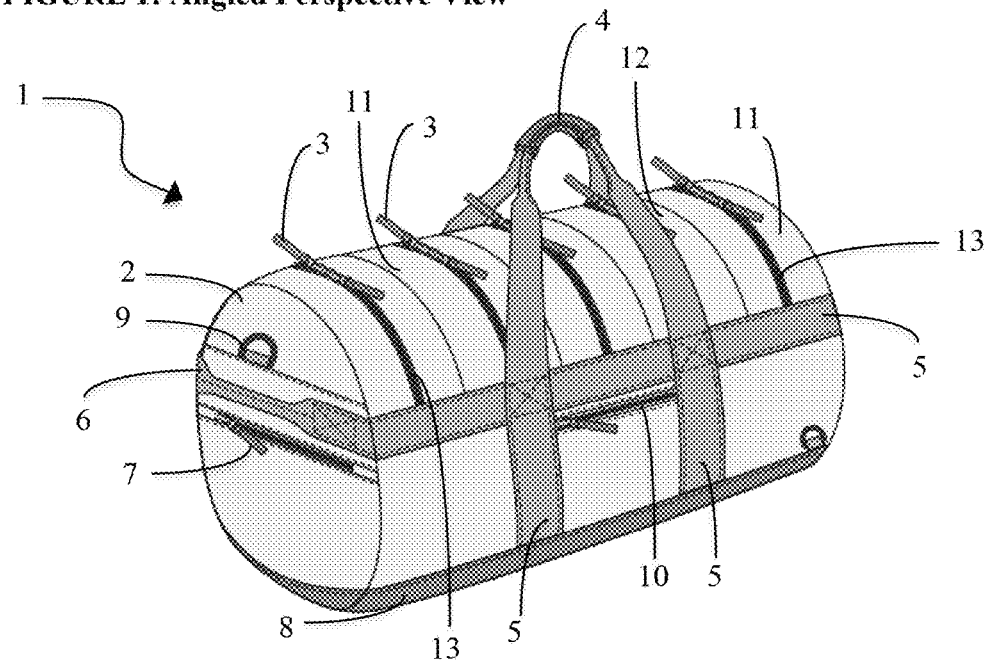
FIGURE 2: Side Width View
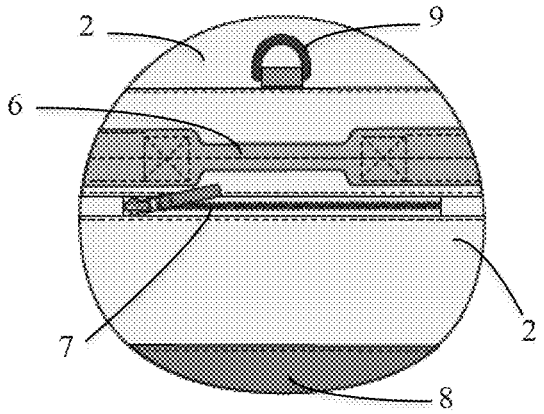

FIGURE 3: Side Length View
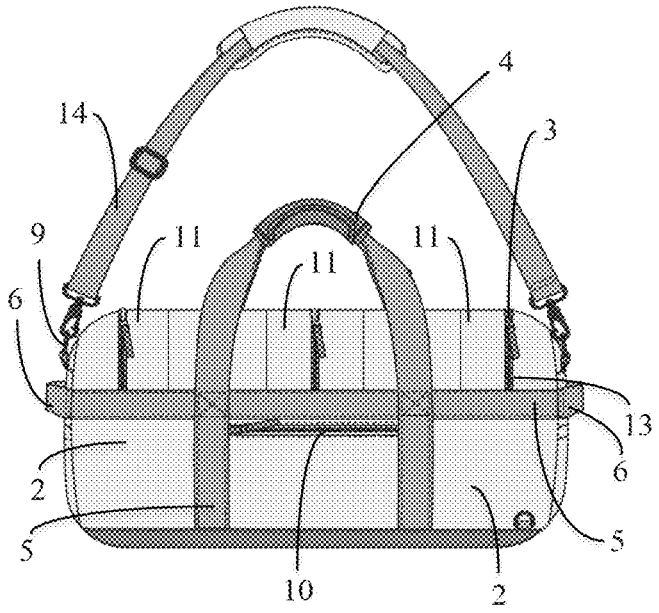
FIGURE 4: Transparent Schematic Angled Perspective View
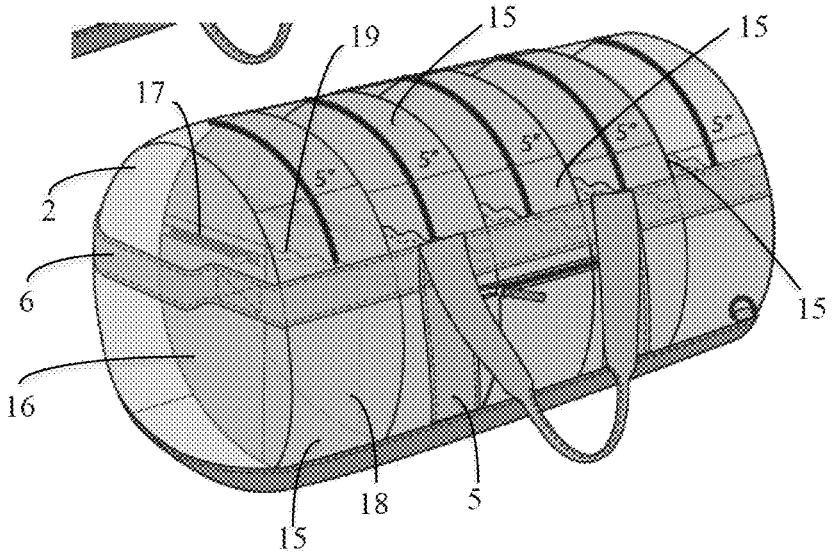

FIGURE 5: Side Cut View
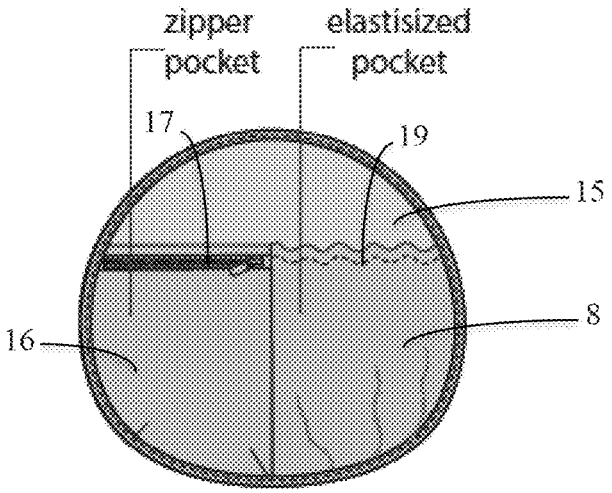
FIGURE 6: Bottom/Base View with Backpack Straps Fastened
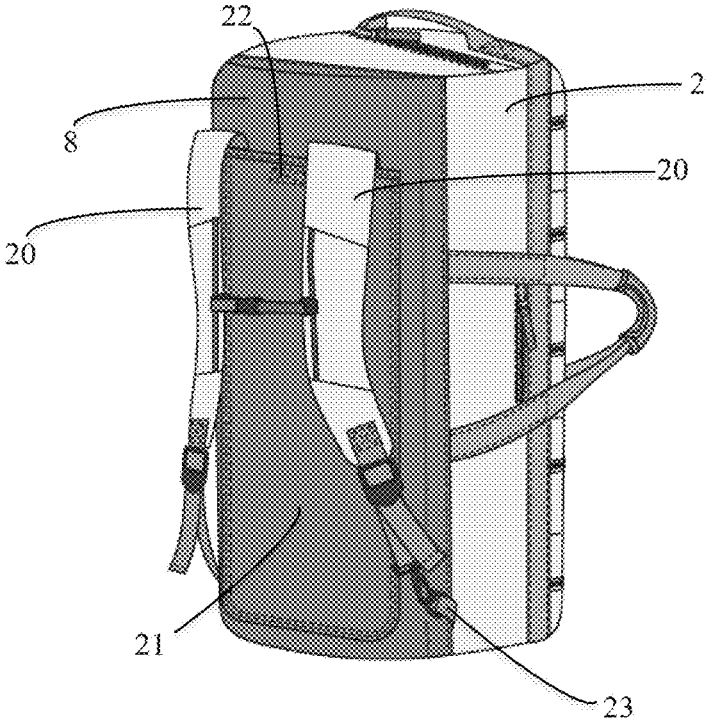

Figure 7: Bottom/Base View with Backpack Straps Stowed
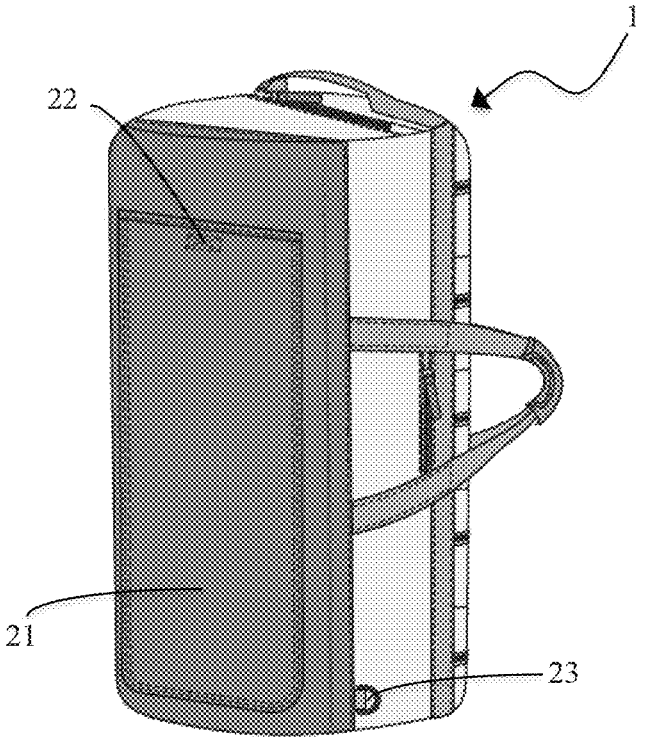

MULTI COMPARTMENT FAMILY TRAVEL BAG

This application claims priority of Provisional Patent Application No. 62/982,077 filed on Feb. 27, 2020.

FIELD OF THE INVENTION

The present invention relates generally to improvements in portable carrying cases, travel or utility bags known as duffel or roll-type bags. More particularly, the invention relates to improvements made in the organizational utility or compartments and accessibility of space within elongated cylindrical bags.

BACKGROUND OF INVENTION

Families traveling on any length of trip are well acquainted with the difficulties of organizing, packing, accessing and carrying items for children. Children necessitate a complicated array of travel goods including diapers, clothing, toys, food, hygiene items, accessories, etc. Young travelers are incapable of carrying their own travel bags and the burden of their packing falls upon their caretakers. If multiple kids are involved, caretakers often become responsible for three or four bags in addition to their own luggage. This invention aims to simplify the travel experience for families by creating one bag with the ability to carry, organize, and easily access items for multiple children. The invention of one compartmentalized travel bag with the ability to accommodate items for many users will help families organize and carry needed goods.

The need for improved organization in carrying bags and luggage systems is well established. Many travel and athletic bags respond to this need, creating compartments within or beneath a bag's main compartment. Some inventions introduce removable or collapsable dividers in bag and luggage systems to help travelers organize their goods. An example of a duffel bag with removable interior partitions is described in US Patent Application No. 2010/0213020 A1 by Lynch-Ringvold. This invention is useful for individuals in search of a way to reconfigure a duffel bag during the course of a trip. Such reconfigurations can organize and accommodate soiled laundry or other gear that warrants impromptu partitions within a large main compartment. However, such an invention does not resolve the problem of how to offer multiple travelers immovable, separately accessed compartments within one bag.

Duffel and luggage type bags with multiple, easily accessible compartments exist, but are not built for the specific needs of traveling families. Sports bags are constructed with unique elements for their athlete owners and the gear they carry. US Patent Application No. 2002/0148741 A1 by Stobbs et al. describes an athletic equipment bag built with multiple large and small storage compartments for the segregation of athlete's shoes, bats, balls, etc. Another bag using divided zippered compartments for the organization of construction tools is described in US Patent Application No. 2007/0137960 A1 by Redzisz. These prior proposed bags describe the advantage of distinct, externally accessed compartments to assist their users, but their descriptions are only useful in providing a background for this invention. Such bags are not designed for the specific needs and equipment carried by traveling family groups.

Traveling families pack specific gear (often for multiple children), including, but not limited to: snacks, clothing, thermometer, toothbrushes, footwear, diapers, swim gear, comfort toys, etc. It is frustrating and difficult to locate specific items for specific children in traditional, one-compartment duffel bags. Prior art of such bags reveals little to no organizational utility designed to solve this problem. There is a great need for a multi-compartment family travel bag that is designed specifically to organize and carry the diverse necessities of traveling families. Keeping track of small, important items like binkis while on the road, alongside awkward bulky items such as a breast pump is an ongoing challenge. Often, the small specific items get lost in the shuffle of clothing and diapers within traditional duffel bags. Or, caregivers need to carry multiple bags because one bag will not meet all their needs. For example, when groups travel for specific activities such as skiing, caregivers are responsible for all the poles, boots, skiis plus clothing and gear for every child. Traditional large duffel bags offer no compartments or pouches to help caregivers organize the gear for individual skiers. Gear easily becomes a tangled mess where smaller items are easily lost. The need for group gear organization within one bag is great.

As airlines continue to increase fees for luggage and carry-on items, travelers are increasingly aware of their need to pack light. This is a difficult task for most families, as traditional luggage cases and duffel bags do not encourage simplified packing. Minimalism is a necessary adaptation for modern family travel, and the need for efficient, organized packing solutions is greater than ever. U.S. Pat. No. 9,215,918 B2 by Kao et al. creates an internal removable organizer within an improved luggage bag. While this improvement helps individual travelers cut down on excess baggage, it does not allow external access or the ability to organize goods for multiple people. Prior art reveals many pitfalls, highlighting the need for improved organization and quick exterior access to bag and luggage design. Such an improvement would help parents pack lighter and more efficiently.

Family travelers need improved organizational elements within duffel type travel bags. Because the construction of most existing duffel-type travel bags revolves around one large compartment with little to no interior pockets, family and group travelers are without simple, efficient luggage and bag options. The diverse needs of family travelers calls for an improved, compartmentalized duffle bag.

OBJECTS AND SUMMARY OF THE INVENTION

It is an object of this invention to provide families or groups with the ability to organize, carry, and externally access travel goods for multiple people within a multi compartment travel bag.

It is a further object of this invention to enable travelers to simplify packing items in one bag containing multiple immovable, compartmentalized sections, while avoiding the drawbacks of prior art.

It is a further object of this invention to build internal bungees, zippers and organizational components within each compartment to maximize the bag's organizational utility for the user.

The bag can be provided with stowable backpack straps fastening to the bottom of the bag, giving caregivers a hands-free carrying option.

The bag can be provided with a plurality of compartments accessed via zippers or fasteners along the top of the bag, opening individually to the interior space of the bag.

Another object of this invention is to provide children with the ability to independently access and locate important items without digging through the belongings of other persons with whom they travel.

It is also an object of this invention to provide an improved compartmentalized duffel design that can be made available to consumers in a range of styles and sizes, such as: small, medium, large, personal, family, sports and travel versions, etc.

It is also an object of this invention to provide travelers with a variety of available styles, colors, constructed in a variety of materials, including but not limited to: durable water resistant materials of various types of washable materials or other fabrics in a range of textures and prints.

This invention can be provided with multiple hand grip and carrying options, such as: an over the shoulder strap, end handles, backpack straps, hand grab loops, etc. While not shown on this rendering, the bag or carrying case can be provided with or without wheels and a pull handle.

These and many other features, aspects and advantages of this invention will be understood by examining attached drawings and reading the accompanying descriptions included hereafter.

BRIEF DESCRIPTION OF THE DRAWINGS

FIG. 1 is an angled perspective view of a multi-compartment family duffel-type travel bag, according to one preferred embodiment of this invention.

FIG. 2 is a side width view of this invention, showing a direct view of an end cap of one compartment, according to one preferred embodiment of this invention.

FIG. 3 is a side length view, showing one preferred embodiment of the external construction of this invention.

FIG. 4 is a transparent angled schematic perspective view, showing the internal perspective of one preferred embodiment of this invention. This transparent view shows the immovable dividers, zipper access for multiple compartments, and interior organizational components built into the bag.

FIG. 5 is a side cut view, showing one preferred embodiment of the internal compartments housed within one section of the multi compartment bag.

FIG. 6 is a bottom/base view with stowable backpack straps attached to the "D" rings along the far base perimeter of the bag.

FIG. 7 is a bottom/base view of the bag with stowable backpack straps stowed within the large base pocket of the bag.

DETAILED DESCRIPTION OF THE INVENTION

With reference to the drawings in this preferred embodiment, FIG. 1 shows the duffel 1 as a generally cylindrical, soft sided article of luggage with multiple distinct zippered compartments 11. Each compartment 11 is independently constructed and accessed along the top by a zipper 3 sewn in a crescent shape 13. Permanent, immovable internal panels 15 of fabric separate one compartment 11 from the next, repeatedly through the length of the bag. Compartments 11 are sewn 19 as if stacked end cap 12 to end cap 12 and accessed individually by external zippers. Additional small zippered pockets 7, 10 can also be sewn onto the body 2 and end caps of the bag 1 for easy access to passports, keys or other small personal items.

Surrounding the entire length and width of the bag is a thick band of webbing 5 to add stability and aesthetics to the structure of the bag. With reference to FIG. 2, said webbing can be sewn into a sturdy hand grip 6 on both end caps of the bag. As shown in FIG. 3, webbing can also be sewn, wrapping the body of the bag with stirrups 4 that can loop into a hand grip position. The hag can also include "D" rings 9 on each end cap, whereupon a long shoulder strap 14 can be fastened to provide the user with multiple carrying options. In its preferred embodiment, the shell and base of the hag are formed of a durable, sturdy material.

Zippered openings 13 to each individual compartment can include two zippers 3, so as to enable users to zip and unzip compartments easily from either direction. The number of multiple compartments 11 is shown on this preferred embodiment as five compartments, each at a width of five inches, but measurements and quantity of compartments can vary. In a transparent schematic view of the bag, as in FIG. 4, the barriers 15 between each compartment are visible. These barriers are permanently sewn 19 around the entire wall of the compartment, completely dividing one space from the next. As shown in the side cut view of FIG. 5, this interior dividing wall 15 can contain further organizational components, such as, but not limited to: bungee pouches 18, 19, zippered pockets 16, 17, and/or other organizational elements built into the lining of each compartment.

Another carrying feature which can be added to the bag is the stowable backpack straps 20 built into an elongated pocket 21 on the base 8 of the bag, as shown in FIG. 6. The elongated base pocket 21 is built specifically to house the backpack straps 20 when they are not in use. In this preferred embodiment, these backpack straps 20 are permanently fastened at the base 8, near one end cap 22 of the bag. When in use, said backpack straps can be removed from the base pocket and clipped with sturdy fasteners to "D" rings 23 secured near the opposite end cap of the bag, as shown in FIG. 6. When a user is not in need of the backpack carrying option, the action is reversed as straps unclip and tuck into the elongated base pocket, as shown in FIG. 7. Backpack carrying options can enable users with hands-free mobility while carrying the bag.

The invention is not limited to the foregoing described embodiments. Many modifications and variations are possible without departing from the primary concepts. Many fabrics, styles, sizes, colors and applications are possible without departing from the main scope of the invention.

I claim:

1. A soft-sided carrying bag comprising:

a pliable shell having a base, end walls, side walls and a top portion joined together to form a generally tube-like structure with an exterior and an interior;

a plurality of handles and one or more carrying straps attached to the exterior shell for transport of the bag;

a plurality of compartments dividing the internal volume of the bag into multiple independent spaces, each interior compartment including an external access point and closure means formed as a crescent shaped zipper along said compartment's top wall in a width-wise direction, the plurality of compartments formed by four upstanding adjoining interior walls, and a base joined together to form separate sections within the carrying bag;

said plurality of compartments constructed in the bag are formed by dividers wherein said dividers are permanently attached around an entire interior edge of the pliable shell, completely and permanently dividing and isolating one of the plurality of compartments from an adjacent of the plurality of compartments, wherein each of the plurality of compartments has an approximately equal volume formed by the dividers being spaced equidistantly apart, such that the bag has no primary compartment;

said closure means positioned along the external access point of each said compartment to contain the space therein, each closure means being the only way to access the corresponding one of the plurality of compartments;

wherein each of the plurality of compartments contain a plurality of interior pockets attached to one of the dividers, wherein a first of the plurality of interior pockets has a zipper closure, and wherein a second of the plurality of interior pockets has an elastic closure;

a webbing surrounding a length and a width of the bag to provide stability to the soft-sided carrying bag, the webbing positioned on the length of the bag directly adjacent to opposite ends of each crescent shaped zipper, wherein two of the plurality of handles are connected to the webbing and extend away from the webbing to form a loop and extend on the side of the bag having the crescent shaped zippers above the crescent shaped zippers;

wherein the two of the plurality of handles and carrying strap extend over a top of the bag on the same side as the crescent shaped zippers of the plurality of compartments; and wherein the bag is a single bag.

2. The carrying bag of claim 1, wherein the dividers between the compartments comprise materials fastened to the exterior walls of the bag.

3. The carrying bag of claim 1, wherein compartments contain a plurality of interior pockets within said compartment space wherein a first of the plurality of interior pockets has a zipper closure, and wherein a second of the plurality of interior pockets has an elastic closure.

4. The carrying bag of claim 1, comprising material color application.

5. The carrying bag of claim 1 comprising handles and carrying straps with fastening and unfastening qualities.

6. The carrying bag of claim 1 comprising straps with fastening and unfastening components and a stow away compartment along the base of the bag.

7. The carrying bag of claim 6 comprising said carrying straps fastening to exterior adjoiners facilitating diverse carrying methods.

8. The carrying bag of claim 6 wherein back carrying straps stow away in a compartment with a closure mechanism in the bag.

9. A carrying bag comprising:

a shell with a base, end walls, side walls and top portion joined together to form a hollow structure having an exterior and an interior;

a plurality of handles and one or more carrying straps comprising various attachments to the exterior shell;

a plurality of compartments dividing the internal volume of the bag into multiple independent spaces, each interior compartment comprising an external access point and closure means along said compartment's top wall, a plurality of upstanding adjoining interior walls, and a base joined together to form separate sections within the carrying bag;

said plurality of compartments formed by dividers wherein said dividers are permanently sewn around an entire interior edge of the pliable shell, completely and permanently dividing and isolating one of the plurality of compartments from an adjacent of the plurality of compartments-unit and, said closure means positioned along the opening of each said compartment to contain the space therein;

wherein each of the plurality of compartments has an approximately equal volume formed by the dividers being spaced equidistantly apart, such that the bag has no primary compartment;

a webbing surrounding a length and a width of the bag to provide stability to the carrying bag, the webbing positioned on the length of the bag directly adjacent to opposite ends of each closure means, wherein two of the plurality of handles are connected to the webbing and extend away from the webbing to form a loop and extend upward on the side of the bag having the closure means, above the closure means;

wherein the two of the plurality of handles and carrying strap extend over a top of the bag on the same side as the closure means of the plurality of compartments; and wherein said shell encloses the plurality of compartments of the bag.

10. The carrying bag of claim 9, wherein compartments contain a plurality of interior pockets and organizers wherein a first of the plurality of interior pockets has a zipper closure, and wherein a second of the plurality of interior pockets has an elastic closure.

11. The carrying bag of claim 9 comprising diverse color application.

12. The carrying bag of claim 9 comprising handles and carrying straps that fasten and unfasten.

13. A soft-sided carrying bag comprising:

a pliable shell that has a base, end panel, side panel and a top panel joined together to form a generally tube-like structure having an exterior and an interior;

a plurality of handles and carrying straps attached to the shell for transport of the bag;

a plurality of compartments, equilaterally distributed, dividing the internal volume of the bag into multiple independent spaces, each interior compartment including an external access point and closure means along said compartment's top panel, four upstanding adjoining interior panels, and a base joined together to form separate sections within the carrying bag;

said plurality of compartments constructed in the bag are formed by dividers wherein said dividers are permanently attached around an entire interior edge of the pliable shell, completely and permanently dividing and isolating one of the plurality of compartments from an adjacent of the plurality of compartments, and, a closure means applied along the opening of each said compartment to contain the space therein wherein each of the plurality of compartments has an approximately equal volume formed by the dividers being spaced equidistantly apart, such that the bag has no primary compartment;

a webbing surrounding a length and a width of the bag to provide stability to the carrying bag, the webbing positioned on the length of the bag directly adjacent to opposite ends of each closure means, wherein two of the plurality of handles are connected to the webbing and extend away from the webbing to form a loop and extend upward on the side of the bag having the closure means, above the closure means;

wherein the two of the plurality of handles and carrying strap extend over a top of the bag on the same side as the closure means of the plurality of compartments.

14. The carrying bag in claim 13 comprising materials of various types and colors.

15. The carrying bag in claim 13 wherein said compartments contain a plurality of internal pockets and organization components wherein a first of the plurality of interior pockets has a zipper closure, and wherein a second of the plurality of interior pockets has an elastic closure.

* * * * *